US010436538B2

(12) United States Patent
Moore et al.

(10) Patent No.: US 10,436,538 B2
(45) Date of Patent: Oct. 8, 2019

(54) AUTOMATIC PISTOL SLIDE WITH LASER

(71) Applicant: CRIMSON TRACE CORPORATION, Wilsonville, OR (US)

(72) Inventors: Larry E. Moore, Cottonwood, AZ (US); Aaron Moore, Cottonwood, AZ (US)

(73) Assignee: CRIMSON TRACE CORPORATION, Wilsonville, OR (US)

( * ) Notice: Subject to any disclaimer, the term of this patent is extended or adjusted under 35 U.S.C. 154(b) by 27 days.

(21) Appl. No.: 15/600,571

(22) Filed: May 19, 2017

(65) Prior Publication Data

US 2018/0335269 A1 Nov. 22, 2018

(51) Int. Cl.

| | |
|---|---|
| ***F41A 33/02*** | (2006.01) |
| ***F41G 1/35*** | (2006.01) |
| ***F41A 19/35*** | (2006.01) |
| ***F41A 3/12*** | (2006.01) |

(Continued)

(52) U.S. Cl.

CPC ..... *F41A 33/02* (2013.01); *F41A 3/12* (2013.01); *F41A 3/54* (2013.01); *F41A 19/35* (2013.01); *F41G 1/35* (2013.01); *F41C 3/00* (2013.01)

(58) Field of Classification Search

CPC ..... F41A 33/02; F41G 1/35; F41G 3/2616; F41G 3/2622; F41G 3/2655; G09B 9/003

USPC ..... 42/116, 114, 115, 134, 146; 434/16, 17, 434/19, 21

See application file for complete search history.

(56) References Cited

U.S. PATENT DOCUMENTS

| | | | | |
|---|---|---|---|---|
| 1,490,272 A * | 4/1924 | Hickam | ..... | F41A 33/02 362/111 |
| 1,898,566 A | 2/1933 | Noel | | |
| 2,268,056 A | 12/1941 | Nelson et al. | | |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

UPSTO; Notice of Allowance and Fees Due dated Jul. 11, 2017 in U.S. Appl. No. 15/130,744.

(Continued)

*Primary Examiner* — Stephen Johnson
*Assistant Examiner* — Benjamin S Gomberg
(74) *Attorney, Agent, or Firm* — Schwabe Williamson & Wyatt, P.C.

(57) ABSTRACT

A slide for an automatic pistol includes a cavity, a housing in the cavity, a laser module at least partially received in the housing, a power source, circuitry, and a striker. The slide has a first mode in which it emits laser light and a second mode in which it does not emit laser light. The striker has a first position in which it does not cause the laser module to emit laser light. When the pistol's trigger is pulled, the pistol's firing pin contacts the striker and moves the striker backwards from the first position to a biased position. When the firing pin moves out of contact with the striker, the striker moves forward to a second position and causes the circuitry to transmit power from the power source to the laser module, which causes the laser module to emit laser light.

18 Claims, 10 Drawing Sheets

(51) Int. Cl.
*F41A 3/54* (2006.01)
*F41C 3/00* (2006.01)

(56) References Cited

U.S. PATENT DOCUMENTS 2,308,627 A 1/1943 Rickenbacher
2,357,951 A 9/1944 Hale
2,430,469 A 11/1947 Karnes
2,597,565 A 5/1952 Chandler et al.
2,701,930 A 2/1955 Dolan
2,773,309 A 12/1956 Elliot
2,780,882 A 2/1957 Temple
2,826,848 A 3/1958 Davies
2,844,710 A 7/1958 Rudolf
2,894,117 A * 7/1959 Koskey ..... F41A 33/02 362/111
2,904,888 A 9/1959 Niesp
2,926,916 A 3/1960 Pearson
3,104,478 A 9/1963 Strauss
3,112,567 A 12/1963 Flanagan
3,192,915 A 7/1965 Norris et al.
3,284,905 A 11/1966 Simmons
3,510,965 A 5/1970 Rhea
3,526,972 A 9/1970 Sumpf
3,573,868 A 4/1971 Giannetti
3,618,673 A 11/1971 Gossett
3,633,285 A 1/1972 Sensney
3,641,676 A 2/1972 Knutsen et al.
3,645,635 A 2/1972 Steck
3,748,751 A 7/1973 Breglia
3,801,205 A 4/1974 Eggenschwyler
3,813,795 A 6/1974 Marshall
3,914,873 A 10/1975 Elliot, Jr. et al.
3,948,522 A * 4/1976 Fixler ..... A63B 69/3614 463/50
3,992,783 A 11/1976 Dunlap et al.
3,995,376 A 12/1976 Kimble et al.
4,026,054 A 5/1977 Snyder
4,048,489 A 9/1977 Giannetti
4,063,368 A 12/1977 McFarland
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,346,530 A 8/1982 Stewart
4,348,828 A 9/1982 Snyder
4,352,665 A 10/1982 Kimble et al.
4,452,458 A 6/1984 Timander
4,481,561 A 11/1984 Lanning
4,487,583 A 12/1984 Brucker
4,488,369 A 12/1984 Van Note
4,541,191 A 9/1985 Morris et al.
4,567,810 A 2/1986 Preston
4,662,845 A 5/1987 Gallaher
4,713,889 A 12/1987 Santiago
4,763,431 A 8/1988 Allan et al.
4,825,258 A 4/1989 Whitson
4,830,617 A 5/1989 Hancox et al.
4,860,775 A 8/1989 Reeves
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,004,423 A * 4/1991 Bertrams ..... F41A 33/02 434/22
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,092,071 A 3/1992 Moore
5,119,576 A * 6/1992 Erning ..... F41A 33/02 362/111
5,177,309 A 1/1993 Willoughby et al.
5,178,265 A 1/1993 Sepke
5,179,235 A 1/1993 Toole
5,194,007 A 3/1993 Marshall
5,197,796 A 3/1993 Moore
5,208,826 A 5/1993 Kelly
5,179,124 A 6/1993 Schoenwald et al.
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,353,208 A 10/1994 Moore
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,488,795 A * 2/1996 Sweat ..... F41A 33/02 362/112
D368,121 S 3/1996 Lam
5,509,226 A 4/1996 Houde-Walter
5,499,455 A 5/1996 Palmer
5,515,636 A 5/1996 McGarry et al.
5,481,819 A 6/1996 Teetzel
5,531,040 A * 7/1996 Moore ..... F41G 1/35 362/114
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A * 2/1997 Seeton ..... F41A 33/02 12/103
5,618,099 A 4/1997 Brubacher
5,621,999 A 4/1997 Moore
5,622,000 A 4/1997 Marlowe
5,654,594 A 8/1997 Bjornsen, III
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,716,216 A 2/1998 O'Loughlin
5,735,070 A * 4/1998 Vasquez ..... F41A 9/62 42/1.02

(56) References Cited

U.S. PATENT DOCUMENTS 5,787,631 A 8/1998 Kendall
5,788,500 A 8/1998 Gerber
5,822,905 A 10/1998 Teetzel
5,842,300 A * 12/1998 Cheshelski ..... F41A 33/02 42/116
5,842,942 A 12/1998 Doht et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A * 11/2000 Schumann ..... F41A 33/02 434/11
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 9/2001 Kwan
6,295,753 B1 * 10/2001 Thummel ..... F41A 33/02 42/116
6,301,046 B1 10/2001 Tai et al.
6,318,228 B1 11/2001 Thompson
6,327,806 B1 12/2001 Paige
6,363,648 B1 4/2002 Kranich et al.
6,366,349 B1 4/2002 Houde-Walter
6,371,004 B1 4/2002 Peterson
6,378,237 B1 4/2002 Matthews et al.
6,385,893 B1 5/2002 Cheng
6,389,729 B2 5/2002 Rauch et al.
6,389,730 B1 5/2002 Millard
6,397,509 B1 6/2002 Langner
6,421,947 B1 7/2002 Fuller
6,430,861 B1 8/2002 Ayers et al.
6,434,874 B1 8/2002 Hines
6,442,880 B1 9/2002 Allan
6,345,464 B1 12/2002 Kim et al.
6,487,807 B1 12/2002 Kopman et al.
6,499,247 B1 12/2002 Peterson
6,526,688 B1 3/2003 Danielson et al.
6,568,118 B1 5/2003 Teetzel
6,571,503 B2 6/2003 Thorpe
6,572,375 B2 6/2003 Shechter et al.
6,575,753 B2 6/2003 Rosa et al.
6,578,311 B2 6/2003 Danielson et al.
6,579,098 B2 6/2003 Shechter et al.
6,591,536 B2 7/2003 Houde-Walter et al.
6,606,797 B1 8/2003 Gandy
6,614,510 B1 9/2003 Rogers et al.
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
6,682,350 B2 * 1/2004 Kehl ..... F41A 33/02 42/114
D487,791 S 3/2004 Freed
6,742,299 B2 6/2004 Strand
6,749,075 B2 6/2004 Bourque
6,782,789 B2 8/2004 McNulty
6,804,907 B1 10/2004 Slobodkin
6,843,478 B1 1/2005 Hoepelman
6,854,205 B2 2/2005 Wikle et al.
6,860,053 B2 3/2005 Christiansen
6,931,775 B2 8/2005 Burnett
6,935,864 B2 8/2005 Shechter et al.
6,945,782 B2 9/2005 Isoz
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 10/2006 Kim
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 2/2008 Matthews et al.
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 6/2008 Chang
RE40,429 E 7/2008 Oliver et al.
7,409,770 B2 8/2008 Jones
D578,599 S 10/2008 Cheng
7,438,430 B2 10/2008 Kim
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 3/2009 Rogers et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.

(56) References Cited

U.S. PATENT DOCUMENTS 8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 1/2012 Portoghese
8,104,220 B2 1/2012 Cobb
D653,798 S 2/2012 Janice et al.
8,109,024 B2 2/2012 Abst
8,110,760 B2 2/2012 Sharrah et al.
8,127,485 B2 3/2012 Moore
8,132,352 B2 * 3/2012 Lippard ..... F41A 17/56 42/1.06
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,147,304 B2 4/2012 Yamada
8,151,504 B1 4/2012 Aiston
8,151,505 B2 4/2012 Thompson
8,166,694 B2 5/2012 Swan
8,172,139 B1 5/2012 McDonald et al.
8,182,109 B2 5/2012 Matthews et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,543 B2 * 1/2013 Rosol ..... F41A 3/26 89/188
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,646,201 B2 * 2/2014 Hughes ..... F41A 33/02 42/1.01
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker
D710,966 S 8/2014 Barfoot
8,807,779 B1 8/2014 Izumi et al.
8,813,411 B2 8/2014 Moore et al.
8,844,189 B2 9/2014 Moore et al.
D720,423 S 12/2014 Barfoot
8,915,009 B2 12/2014 Caulk
8,919,023 B2 12/2014 Merritt et al.
8,927,083 B2 1/2015 Pell
8,938,904 B1 1/2015 Sellers et al.
D722,125 S 2/2015 Zayatz
8,944,626 B2 2/2015 Matthews et al.
8,944,838 B2 2/2015 Mulfinger
8,991,093 B1 * 3/2015 Calvert ..... F41C 9/06 42/1.14
9,011,279 B2 4/2015 Johnson et al.
9,023,459 B2 5/2015 Hogue
9,146,077 B2 9/2015 Moore
9,182,194 B2 11/2015 Moore
9,188,407 B2 11/2015 Moore
9,243,865 B1 1/2016 Bruhns
9,272,402 B2 3/2016 Hu
9,297,614 B2 3/2016 Moore
9,453,702 B2 9/2016 Bruhns
9,644,826 B2 5/2017 Moore et al.
9,658,031 B1 5/2017 Hedeen
9,772,163 B2 9/2017 Sharrah et al.
9,777,984 B1 10/2017 Bovine
9,791,240 B2 10/2017 Bruhns
D802,704 S 11/2017 Planck
9,810,411 B2 11/2017 Galli
9,829,280 B1 11/2017 Moore et al.
9,841,254 B2 12/2017 Moore et al.
9,915,508 B2 3/2018 Moore et al.
9,982,963 B2 5/2018 Johnson
10,113,836 B2 10/2018 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0104249 A1 8/2002 Lin
2002/0129536 A1 9/2002 Iafrate et al.
2002/0134000 A1 9/2002 Varshneya et al.
2002/0148153 A1 10/2002 Thorpe
2002/0194767 A1 12/2002 Houde Walter et al.
2003/0003424 A1 1/2003 Shechter et al.
2003/0022135 A1 1/2003 Shechter et al.
2003/0029072 A1 2/2003 Danielson
2003/0084601 A1 * 5/2003 Kunimoto ..... F41A 33/02 42/27
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2004/0064994 A1 4/2004 Luke
2005/0044736 A1 3/2005 Liao
2005/0130739 A1 6/2005 Argentar
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny

(56) References Cited

U.S. PATENT DOCUMENTS

2006/0162225 A1 7/2006 Danielson
2006/0191183 A1 8/2006 Griffin
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0227298 A1 9/2010 Charles
2010/0229448 A1 9/2010 Houde-Walter
2010/0263254 A1 10/2010 Glock
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0119868 A1 5/2011 LaLonde
2011/0154712 A1 6/2011 Moore
2011/0162249 A1 7/2011 Woodmansee et al.
2011/0162251 A1 7/2011 Houde-Walter
2011/0185619 A1 8/2011 Finnegan et al.
2011/0225867 A1 9/2011 Moore
2012/0005938 A1 1/2012 Sloan
2012/0047787 A1 3/2012 Curry
2012/0055061 A1 3/2012 Hartley et al.
2012/0110886 A1 5/2012 Moore et al.
2012/0124885 A1 5/2012 Caulk et al.
2012/0129136 A1* 5/2012 Dvorak ..... F41A 33/02 434/18
2012/0144716 A1 6/2012 Cabahug et al.
2012/0144718 A1 6/2012 Danielson
2012/0180366 A1 7/2012 Jaroh et al.
2012/0180367 A1 7/2012 Singh
2012/0180370 A1 7/2012 McKinley
2012/0224357 A1 9/2012 Moore
2012/0224387 A1 9/2012 Moore
2012/0268920 A1 10/2012 Matthews
2013/0185978 A1 7/2013 Dodd et al.
2013/0185982 A1 7/2013 Hilbourne et al.
2013/0205635 A1 8/2013 Hines
2013/0263492 A1 10/2013 Erdle
2013/0318851 A1 12/2013 Diamond
2014/0007485 A1 1/2014 Castejon
2014/0109457 A1 4/2014 Speroni
2014/0157645 A1 6/2014 Moore
2014/0176463 A1 6/2014 Donahoe
2014/0256481 A1 9/2014 Flint
2014/0355258 A1 12/2014 Izumi et al.
2015/0192391 A1 7/2015 Moore
2015/0226508 A1* 8/2015 Hughes ..... F41A 33/02 434/21
2015/0233668 A1 8/2015 Moore
2015/0283459 A1 10/2015 Condon
2015/0308670 A1 10/2015 Moore
2015/0345905 A1 12/2015 Hancosky
2015/0348330 A1 12/2015 Balachandreswaran
2016/0059136 A1 3/2016 Ferris
2016/0084618 A1 3/2016 Hong
2016/0091285 A1 3/2016 Mason
2016/0161220 A1 6/2016 Moore
2016/0169608 A1* 6/2016 Schulz ..... F41A 33/02 434/22
2016/0195366 A1 7/2016 Kowalczyk et al.
2016/0209170 A1 7/2016 Mock et al.
2016/0209174 A1 7/2016 Hartley et al.
2016/0245617 A1 8/2016 Moore
2016/0305748 A1 10/2016 Moore
2016/0361626 A1 12/2016 Moore
2017/0003103 A1 1/2017 Moore
2017/0030677 A1 2/2017 Faifer
2017/0082399 A1 3/2017 Moore
2017/0153095 A1 6/2017 Moore
2017/0160054 A1 6/2017 Moore
2017/0205182 A1* 7/2017 Hughes ..... F41A 33/02
2018/0023923 A1* 1/2018 Uhr ..... F41A 33/02
2018/0058804 A1 3/2018 Moore
2018/0135944 A1 5/2018 Moore
2018/0149443 A1* 5/2018 Dottle ..... F41A 33/02

OTHER PUBLICATIONS

USPTO; Notice of Allowance and Fees Due dated Jul. 31, 2017 in U.S. Appl. No. 15/166,145.
USPTO; Non-Final Office Action dated Aug. 24, 2017 in U.S. Appl. No. 15/253,543.
Glock 17 Nomenclature, downloaded on May 22, 2017.
EPO; Office Action dated Oct. 5, 2011 in Serial No. 09169459.
EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 09169469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 9, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.

(56) References Cited

OTHER PUBLICATIONS

USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Notice of Allowance dated Jun. 24, 2015 in U.S. Appl. No. 14/316,688.
USPTO; Office Action dated Mar. 3, 2015 in U.S. Appl. No. 14/278,315.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
USPTO; Notice of Allowance dated Nov. 15, 2016 in U.S. Appl. No. 14/630,467.
USPTO; Non-Final Office Action dated Aug. 30, 2016 in U.S. Appl. No. 14/955,440.
USPTO; Non-Final Office Action dated Oct. 6, 2016 in U.S. Appl. No. 15/243,813.
USPTO; Office Action dated Feb. 24, 2017 in U.S. Appl. No. 15/166,145.
USPTO; Notice of Allowance dated Mar. 7, 2017 in U.S. Appl. No. 14/630,467.
USPTO; Notice of Allowance dated Apr. 26, 2017 in U.S. Appl. No. 15/130,744.
USPTO; Final Office Action dated May 18, 2017 in U.S. Appl. No. 15/243,813.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
USPTO; Non-Final Office Action dated Jun. 2, 2017 in U.S. Appl. No. 14/963,475.
USPTO; Requirement for Restriction dated Jun. 5, 2017 in U.S. Appl. No. 14/863,304.
USPTO; Supplemental Notice of Allowance dated Sep. 13, 2017 in U.S. Appl. No. 15/166,145.
USPTO; Final Office Action dated Sep. 28, 2017 in U.S. Appl. No. 15/243,813.
USPTO; Notice of Allowance dated Oct. 27, 2017 in U.S. Appl. No. 14/955,440.
USPTO; Notice of Allowance dated Nov. 13, 2017 in U.S. Appl. No. 14/955,440.

(56) References Cited

OTHER PUBLICATIONS

USPTO; Non-Final Office Action dated Dec. 7, 2017 in U.S. Appl. No. 15/075,769.
USPTO; Non-Final Office Action dated Dec. 18, 2017 in U.S. Appl. No. 15/787,134.
USPTO; Final Office Action dated Jan. 16, 2018 in U.S. Appl. No. 14/963,475.
USPTO; Final Office Action dated Feb. 7, 2018 in U.S. Appl. No. 15/253,543.
USPTO; Non-Final Office Action dated Feb. 8, 2018 in U.S. Appl. No. 14/863,304.
USPTO; Non-Final Office Action dated Feb. 26, 2018 in U.S. Appl. No. 15/804,229.
USPTO; Advisory Action dated May 15, 2018 in U.S. Appl. No. 14/963,475.
USPTO; Final Office Action dated Aug. 31, 2018 in U.S. Appl. No. 15/804,229.
USPTO; Notice of Allowance dated Aug. 31, 2018 in U.S. Appl. No. 15/075,769.
USPTO; Non-Final Office Action dated Sep. 19, 2018 in U.S. Appl. No. 15/243,813.
USPTO; Notice of Allowance dated Oct. 3, 2018 in U.S. Appl. No. 15/884,122.
USPTO; Requirement for Restriction dated Jun. 11, 2018 in U.S. Appl. No. 15/181,279.
USPTO; Advisory Action dated Jun. 14, 2018 in U.S. Appl. No. 15/253,543.
USPTO; Notice of Allowance dated Jun. 20, 2018 in U.S. Appl. No. 15/787,134.
USPTO; Non-Final Office Action dated Jul. 3, 2018 in U.S. Appl. No. 14/963,475.
USPTO; Notice of Allowance dated Jul. 18, 2018 in U.S. Appl. No. 15/075,769.
USPTO; Non-Final Office Action dated Jul. 20, 2018 in U.S. Appl. No. 15/253,543.
Google Search for crossbow laser, image search conducted on Nov. 29, 2017, 14 pages.
Google Search for crossbow laser, image search conducted on Nov. 29, 2017, 2 pages.
CrossbowNation—Community-Gear Review, Crossbow Laser Boresighter Bolt Video Review, 1 page, printed on Nov. 29, 2017, dated Apr. 18, 2010.
CrossbowNation, Gear Review, Crossbow Laser Boresighter Bolt Video Review, 6 images taken therefrom, 6 pages, printed on Nov. 29, 2017, dated Apr. 18, 2010.
Ducet, "Arsenal Strike One Review," http://dennyducet.blogspot.com/2015/06/the-arsenal-strike-one-innovative.html, (Jun. 18, 2015).

* cited by examiner

AUTOMATIC PISTOL SLIDE WITH LASER

FIELD OF THE INVENTION

The present invention relates to a laser trainer used with an automatic pistol having a slide.

BACKGROUND OF THE INVENTION

Conventional firearm training can be dangerous, expensive (considering the prices for ammunition and replacement targets) and can only be performed in certain areas, such as shooting ranges. The present invention allows firearm training to be performed safely, inexpensively, and almost anywhere without the use of live ammunition. Incorporated herein by reference is an exploded Figure of a Glock 17 Nomenclature Anglais/Francais and U.S. Pat. No. 9,170,079 entitled LASER TRAINER CARTRIDGE, to the extent these disclosures are not inconsistent with the disclosure in this application.

SUMMARY OF THE INVENTION

Aspects of the invention are directed to a slide that fits on an automatic pistol (or "pistol" or "gun"). Included as part of the slide is a housing in which a laser, printed circuit board ("PCB") or other circuitry, and a power source are positioned. A striker has a (1) first position, wherein power from the power source powers the laser, and (2) second position, wherein power from the power source does not power the laser.

In a preferred embodiment, when the pistol's trigger is pulled it causes the firing pin of the pistol to contact the striker and move the striker backwards away from its first position. This creates tension (preferably by expanding a spring) to move the striker forward when the firing pin disengages from the striker. The striker preferably has a portion that acts as a cam and eventually moves away from the firing pin as the striker is pulled back. When the firing pin moves away from and disengages the striker, the tension on the striker causes it to move forward past its first position to its second position. When in the second position it preferably contacts a switch, such as a momentary switch, that contacts the PCB and completes a circuit to send power from the power source to the laser. This causes the laser to emit light for a short duration, such as about 0.1 seconds, although any suitable duration may be utilized. After the striker moves to its second position, it moves back to its first position, preferably due to being biased by the spring, which is compressed when the striker is in its second position.

The slide may also include a trigger reset assembly, which would preferably be included in the housing. The trigger reset assembly applies force as the trigger is pulled. The force approximates or equals the normal force of pulling the trigger when using live ammunition. When the trigger is pulled and the firing pin is activated, the trigger reset assembly biases the trigger forward back to the trigger's reset position, so it can again be pulled without having to adjust the slide to reset the trigger.

The slide can either be mounted on the pistol when the pistol is sold, or the slide can be provided separately. If a slide according to the aspects of the invention is provided separately, any slide already on the pistol is removed. The pistol barrel and recoil spring are then removed from the slide that was on the pistol, and those are positioned in a slide according to aspects of the invention. The slide according to aspects of the invention is then placed on the pistol.

The method of removing a slide, barrel and recoil spring, and assembling the barrel and recoil spring onto a slide and replacing a slide on an automatic pistol is known by those skilled in the art. Such a method is also usually included as part of the owner's manual for an automatic pistol.

A gun using the invention can hold a fully-loaded magazine, which helps target practicing with a gun having its normal weight when using live ammunition.

A slide according to aspects of the invention may also include a gun barrel and/or recoil spring already mounted on it. Further, a slide according to aspects of the invention could be included as part of a kit that includes multiple nose assemblies to fit various automatic pistol calibers and/or multiple slides.

DETAILED DESCRIPTION OF PREFERRED EMBODIMENTS

Figure 1:
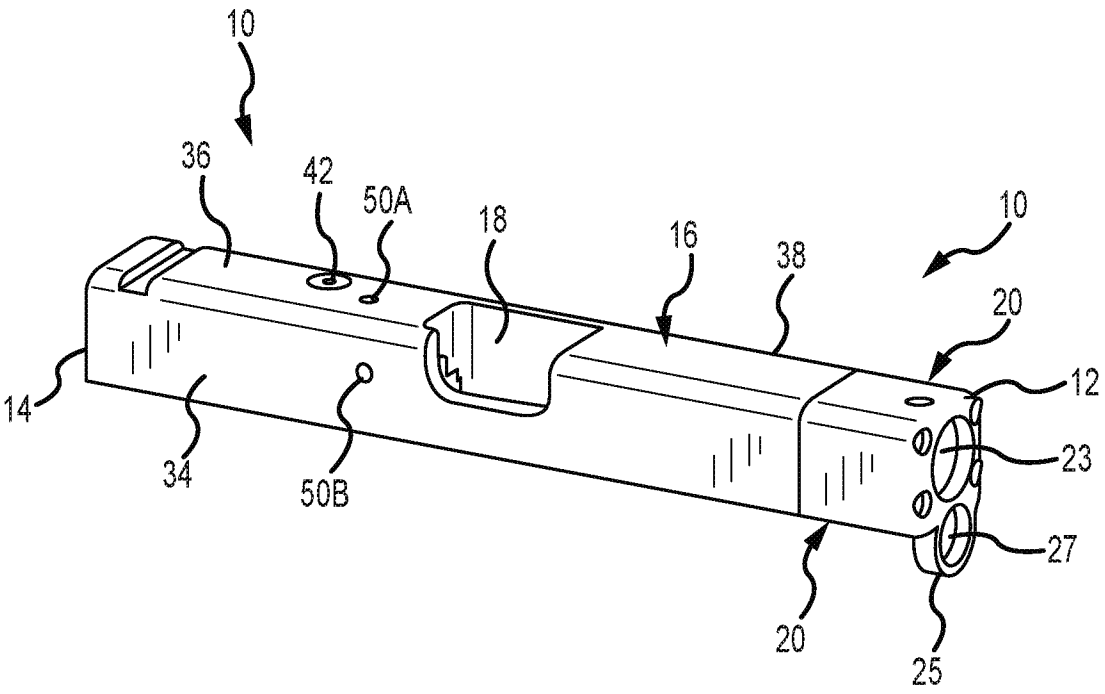
FIG. 1 is an assembled view of a slide according to aspects of the invention.
Figure 2:
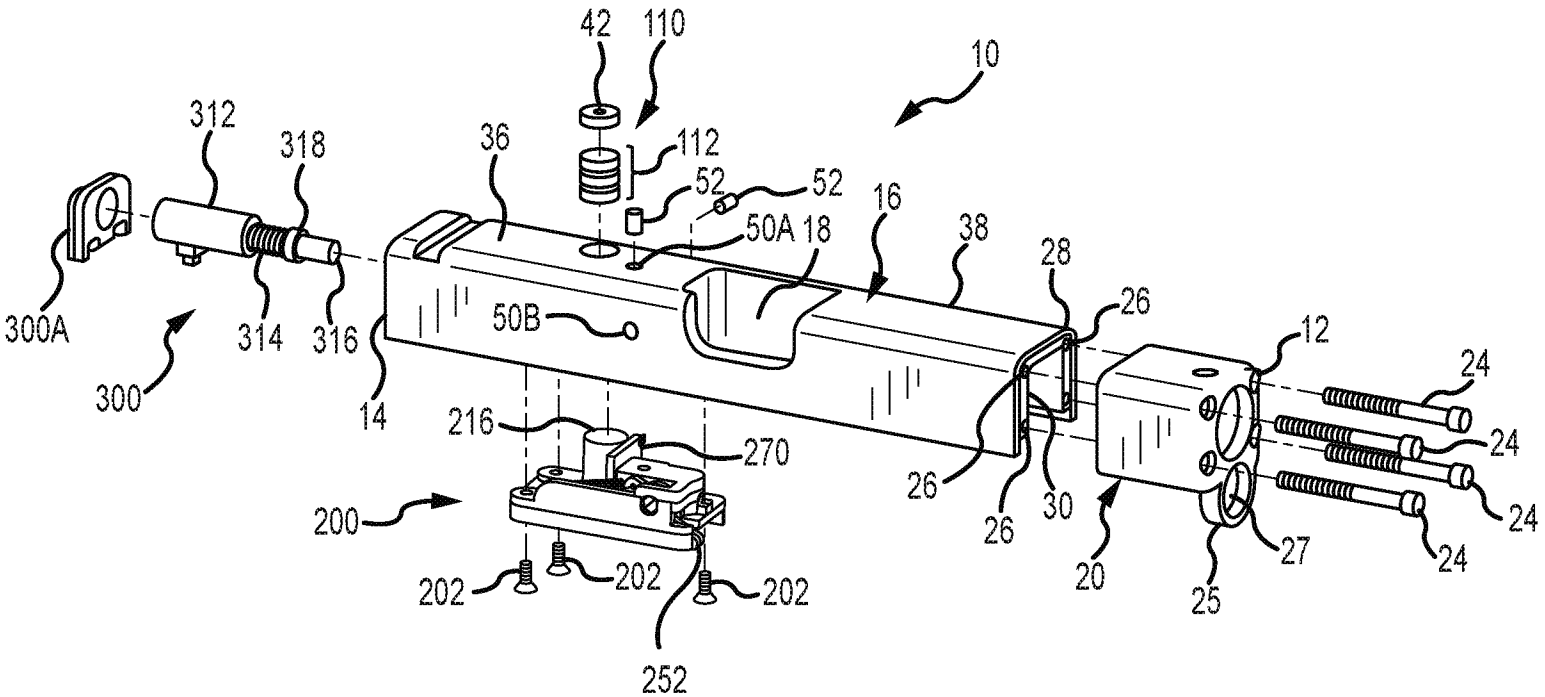
FIG. 2 is an exploded view of the slide of FIG. 1.

Turning now to the Figures, wherein the purpose is to describe preferred embodiments of the invention and not to limit same, FIG. 1 shows a slide 10 in accordance with aspects of the invention. Slide 10 has a first end 12, a second end 14, and a body 16. Body 16 has a partial cavity 18 to assist in gripping and moving slide 10. First end 12 is part of a nose assembly 20. Nose assembly 20 is interchangeable with other nose sections 60, 80, and 100, so slide 10 can fit different pistols, such as (for example) a Glock 17, a Glock 19, a Glock 21, or a Smith & Wesson 40 caliber automatic.

Nose assembly 20 has four openings 22 through which screws 24 pass and are threadingly received in openings 26 at an inner first end 28 of body 16. Nose assembly 20 also has a first opening 23 that aligns with the bore of the gun on which slide 10 is attached, and through which a bullet passes when fired if live ammunition is used. When slide 10 is on a gun, the gun cannot fire live ammunition and when laser module 260 is activated, laser light from laser module 260 is emitted through opening 23.

Figure 3A:
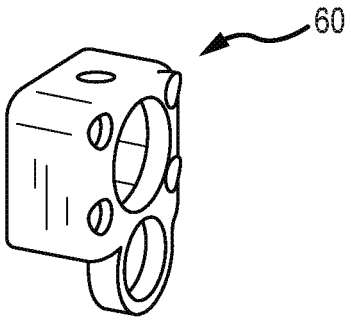
FIGS. 3A-3C are different nose assemblies that can be used as part of a slide according to aspects of the invention.
Figure 3B:
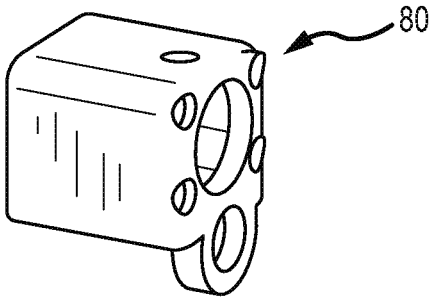
Figure 3C:
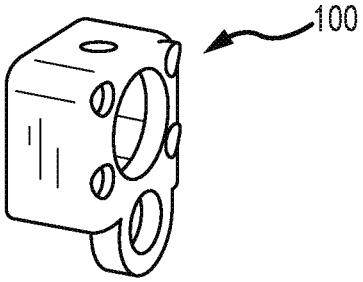
Figure 10:
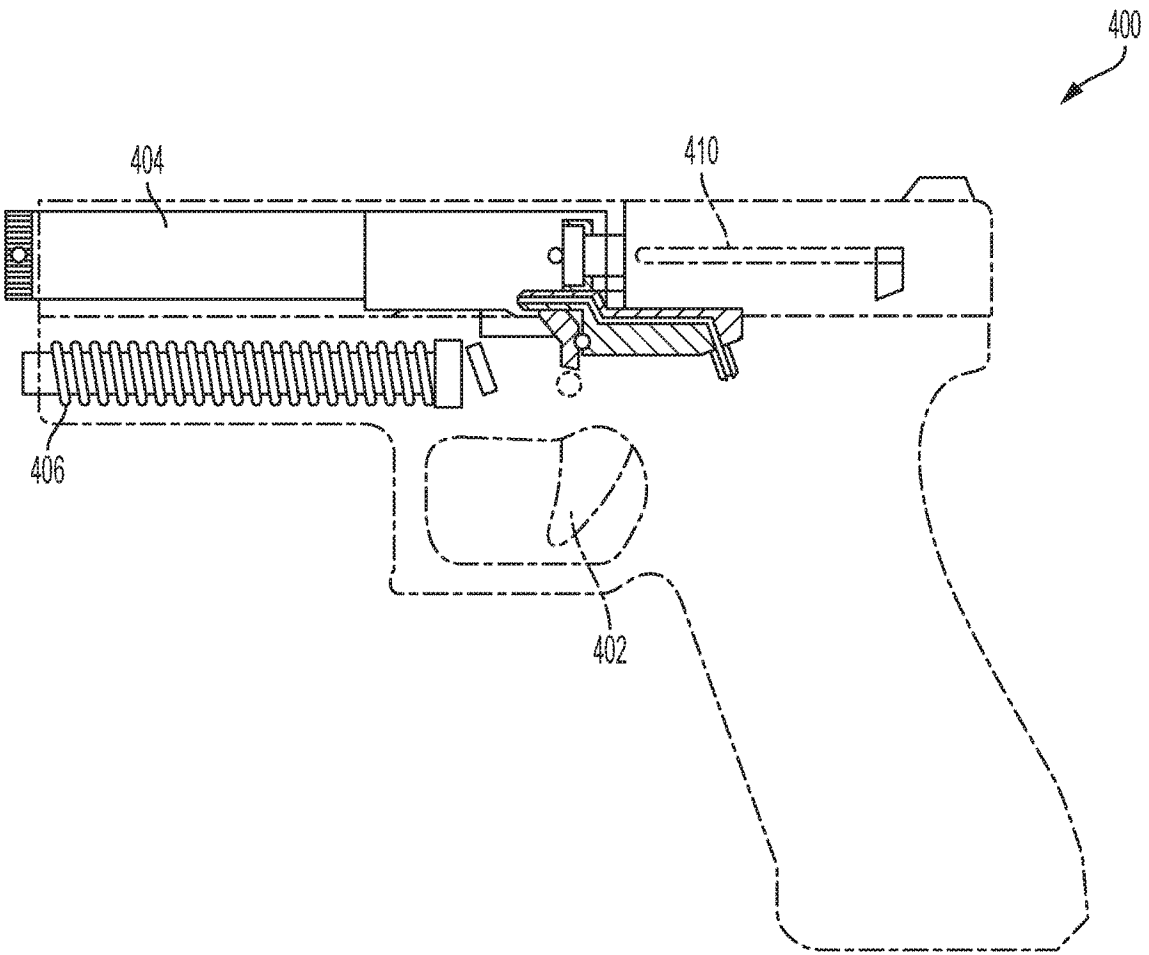
FIG. 10 is a side view of an exemplary automatic pistol.

Nose assembly 20 also has a lower ring 25 with an opening 27. Opening 27 is configured so that a recoil rod (not shown) can move through the opening when the pistol fires live ammunition and the slide recoils backwards when the pistol is fired. Optional nose assemblies 60, 80, and 100 have the same structure as nose assembly 20, and differ only in that they are sized differently for different guns. FIG. 10 shows an exemplary automatic pistol 400 that a disclosed nose assembly and/or one or more slides can be used. As shown in FIG. 10, an exemplary automatic pistol 400 has a trigger 402, a barrel 404, a recoil spring 406 and a firing pin 410. FIGS. 3A-3C show, respectively, optional nose assemblies 60, 80 and 100. As shown, nose assembly 20 fits a Gen 1 Glock 17. Nose assembly 60 fits a Gen 4 Glock 19 and a Smith & Wesson 40 caliber automatic. Nose assembly 80 fits a Gen 1, 2, and 3 Glock 23. Nose assembly 100 fits a Gen 1, 2, and 3 Glock 17 and 22. A slide according to the invention may be provided as part of a kit with multiple nose assemblies and/or one or more other slides.

Body 16 is three-sided with an open bottom and has a cavity 30. Body 16 has a top surface 36, a first-side surface 34, and a second-side surface 38.

The top surface 36 has an opening 40 that is closed by a cap 42. Cap 42 is preferably threadingly received in opening 40 and, in the embodiment shown, is screwed in or out by using an Allen wrench although any suitable fastener and driving device may be used. Opening 40 is used to remove and replace power source 110, which as shown comprises three batteries 112. Power source 110 as shown is preferably three size 392 silver oxide batteries.

Body 16 also includes an opening 50A on top surface 36, an opening 50B on side surface 34, and an opening (not shown) on side surface 38. Openings 50A and the opening not shown on side surface 38 receive set screws 52 that can be tightened or loosened to move a first end 302 of the laser module 260 in order to align light emitted from laser module 260 with the longitudinal axis of a barrel of the automatic pistol on which side 10 is positioned.

Housing 200 is preferably received in cavity 30 of slide 10 and is retained in cavity 10 by fasteners 202 that are received in screw bosses (not shown).

Figure 4:
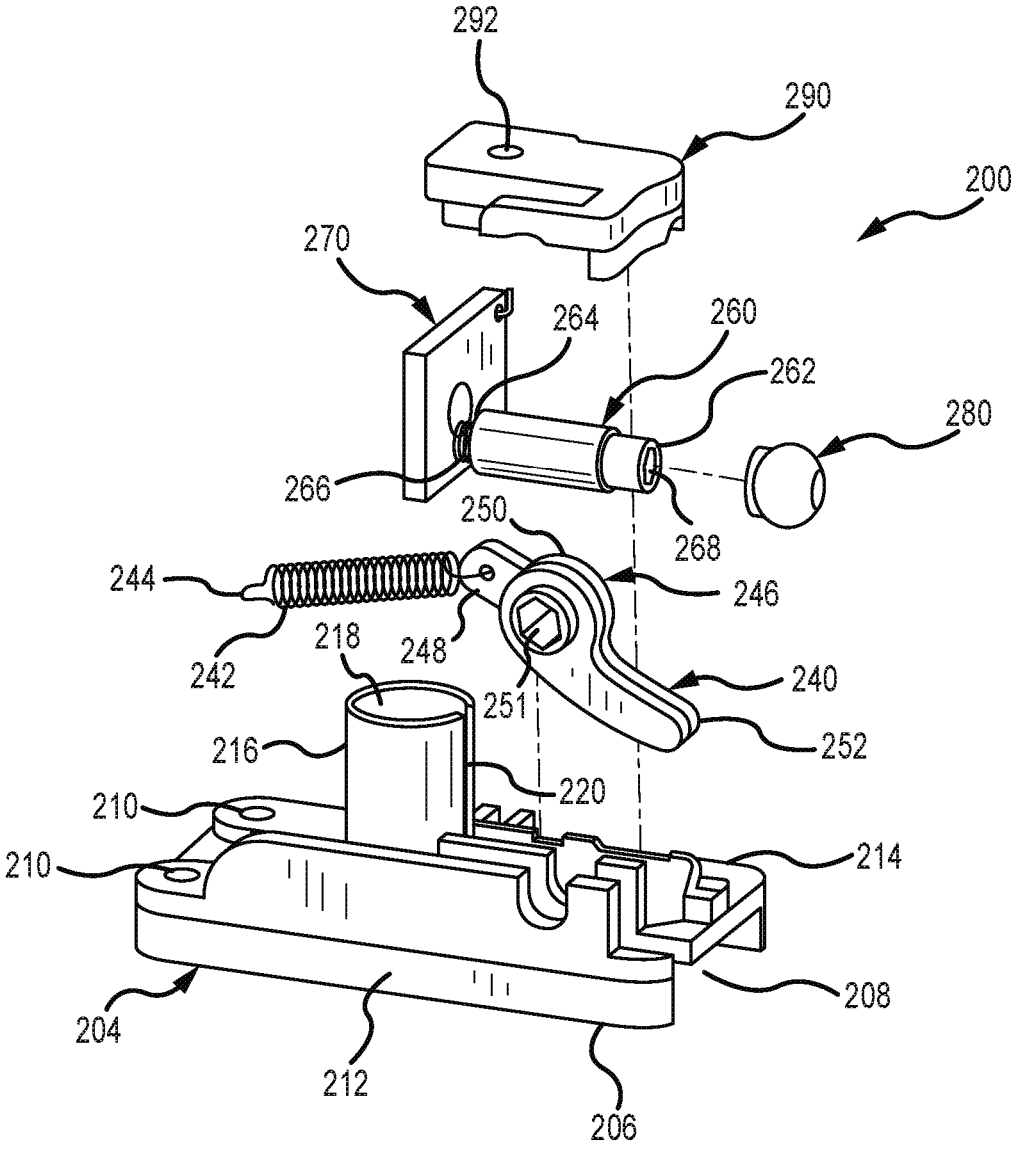
FIG. 4 is an assembled view of a housing according to aspects of the invention that includes a laser.
Figure 5:
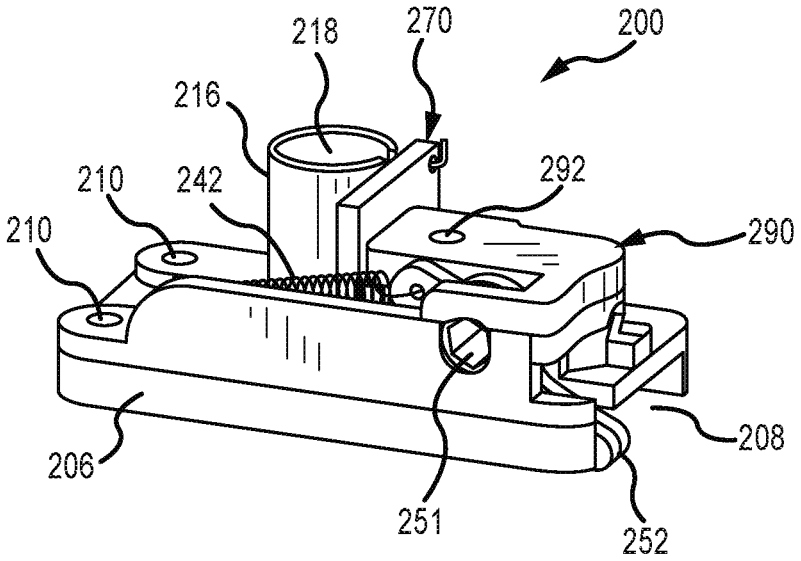
FIG. 5 is an exploded view of the housing of FIG. 4.

Referring to FIGS. 4 and 5, an assembled view and exploded view of housing 200 are shown. Housing 200 is formed of any suitable material such as rigid plastic or a metal, such as steel or aluminum. Housing 200 includes a body 204, a trigger reset assembly 240, a laser module sub-assembly 260, a PCB 270, a module cushion ball 280, and laser pocket cover 290.

Body 204 has a bottom 206, an inner cavity 208, openings 210 through which fasteners 202 pass, a first side 212, and a second side 214. A power source sleeve 216 has a cylindrical opening 218 to receive batteries 112, and a lengthwise slot 220, so the power source 110 can be connected to PCB 270. The inside surface of sleeve 216 is preferable insulated.

Trigger reset assembly 240 replaces the trigger reset assembly on an automatic pistol when the pistol's original slide is used. Trigger reset assembly 240 creates force that approximates, and most preferably replicates, the force of a trigger when pulled using live ammunition. Trigger reset assembly 240 includes a spring 242 having a connector loop 244 that connects to housing 200. Reset assembly 240 also has a trigger bar engagement 246. Trigger bar engagement 246 has a first side 248 that is connected to spring 242, a central portion 250 that has an outer surface that includes a receiving opening 251 for accepting a tool to move trigger reset assembly 240, and an extended portion 252. Opening 251 aligns with opening 50B in side surface 34 of body 16. The purpose of opening 251 is to use the head of a driving tool, such as an Allen wrench, in order to move the trigger bar engagement forward to engage the trigger bar of the pistol.

When installed on a pistol, in order to position trigger bar engagement 246, the slide including trigger reset assembly 240 is pulled back, which moves the trigger bar of the pistol back. A tool is then inserted through opening 50B into opening 251 and used to turn and move trigger bar engagement 246 downward (which is clockwise as shown in FIGS. 4-5) and behind the trigger bar of the pistol. The slide is then moved forward and trigger bar engagement 246 remains behind the trigger bar of the gun unless the slide is removed from the pistol. In this position trigger reset assembly 240 creates resistive force when the trigger of the pistol is pulled, and urges the trigger forward into a reset position after the trigger has been pulled. Then the trigger can be pulled again to again activate the pistol's firing pin. Without the trigger reset assembly 240, once the trigger of the pistol is pulled, the trigger may not fully reset to its forward position and the slide would have to be moved to reset the trigger.

Laser module sub-assembly 260 includes a laser, and has a first end 262 from which laser light is emitted, a second end 264, and an electrically conductive portion 266, which is in communication with PCB 270 to provide power to sub-assembly 260.

PCB 270 includes circuitry necessary to connect the power source 110 to laser module sub-assembly 260 as described and claimed herein. A switch (not shown) which is preferably a momentary switch, may be located on the side of PCB 270 opposite laser sub-assembly 260. Laser module cushion ball 280 fits over first end 262 of laser module sub-assembly 260 to cushion and protect laser module sub-assembly 260. Set screws, such as screws 50A, are positioned against cushion ball 280 when the set screws are received in openings in body 16. Tightening the set screws applies force to cushion ball 280 that causes it to move, which causes first end 262 of laser sub-assembly 260 to move, thereby adjusting the axis along which light emitted from laser sub-assembly 260 travels.

Laser pocket cover 290 covers and retains the trigger bar reset assembly 240, laser module sub-assembly 260, and module cushion ball 280. An opening 292 allows set screw 50A to pass through and contact cushion ball 280.

Figure 6:
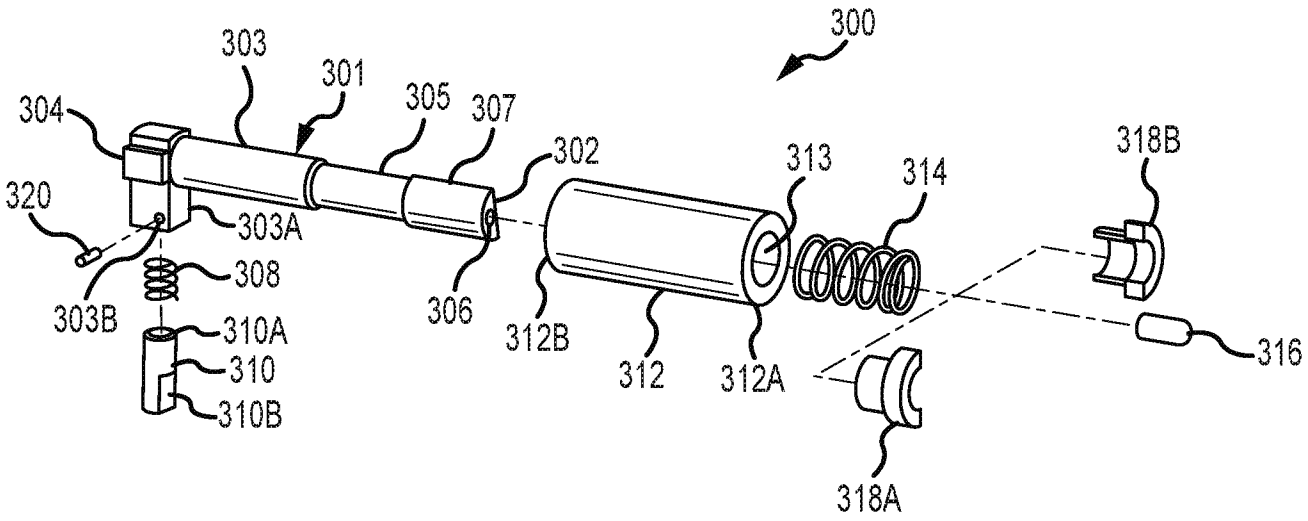
FIG. 6 is an assembled view of a striker in accordance with aspects of the invention.
Figure 7:
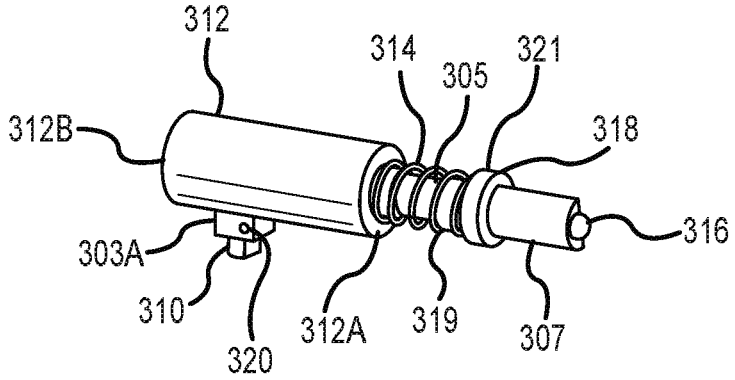
FIG. 7 is an exploded view of the striker of FIG. 6.
Figure 8:
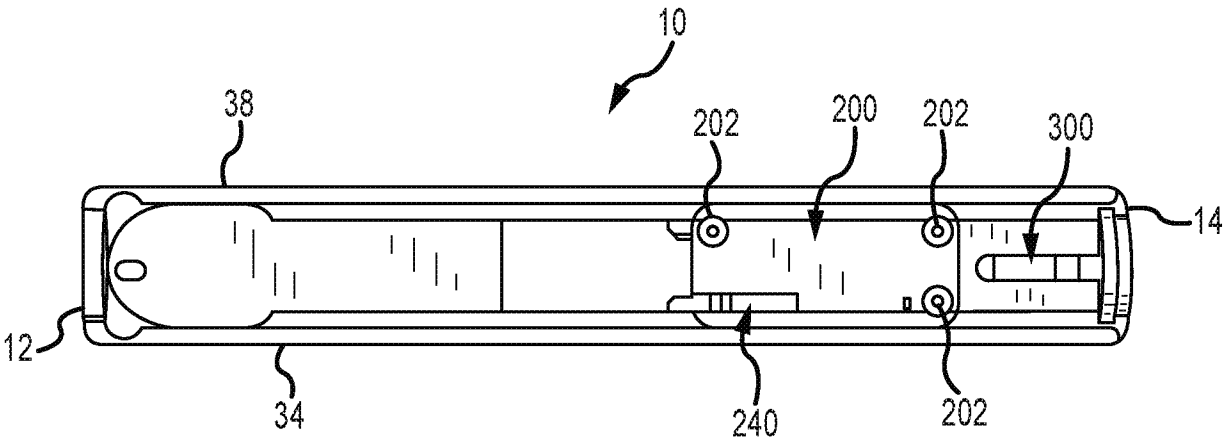
FIG. 8 is a bottom view of the slide of FIG. 1.
Figure 9:
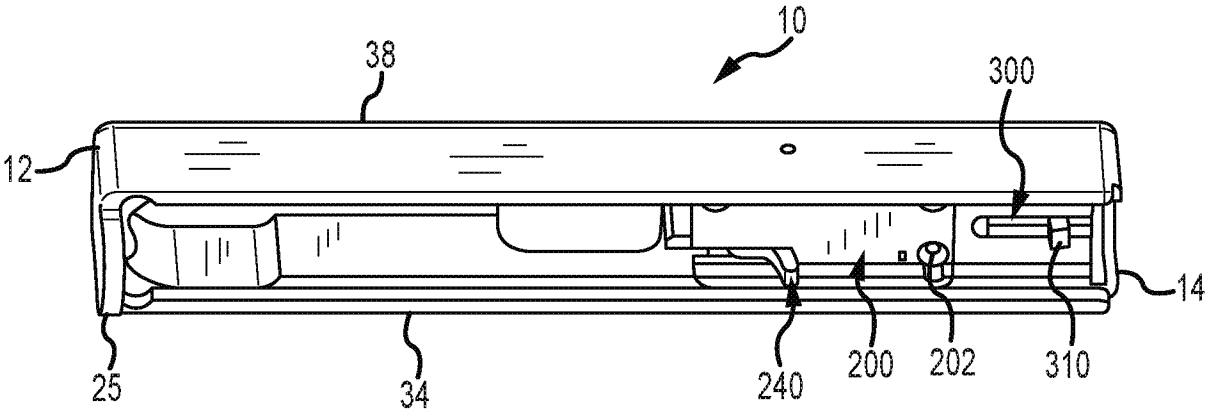
FIG. 9 is an alternate bottom view of the slide of FIG. 1.

FIGS. 6 and 7 show, respectively, a striker 300 assembled and in exploded view. Striker 300 includes a striker body 301 having a first end 302, a second end 304, a first body portion 303, a second body portion 305, and a third body portion 307. As shown in this embodiment, first body portion 303 has first diameter and second body portion 305 has a second diameter that is smaller than the first diameter of first body portion 303. Third body portion 307 as shown is basically semi-circular in shape. An opening 306 is at end 302. At end 304 a receiving portion 303A is connected to or formed as part of first body portion 303. Receiving portion 303A extends downward from first body portion 303 and includes an opening 303B and a cavity (not shown).

Striker 300 also includes a striker sear catch spring 308, a striker sear catch 310 having a shoulder 310A and a flat surface 310B, a striker spacer sleeve 312 having a first end 312A, a second end 312B, an opening 313 therethrough and a bottom slot (not shown), a striker spring 314, a tip 316, a spring cup 318 shown as formed from two parts 318A, 318B, and a striker catch dowel pin 320.

When assembled striker sear catch spring 308 is positioned in the cavity of receiving portion 303A and striker sear catch 310 is pressed into the cavity under sear catch spring 308. Striker sear catch spring 308 presses against the shoulder 310A of striker sear catch 310, and biases striker sear catch 310 downwards. Striker sear catch 310 and striker sear catch spring 308 are retained in the cavity by dowel pin 320 that is received in opening 303B. Cushioning tip 316 is preferably positioned in opening 306, and may be comprised of any suitable material, such as rubber or soft plastic.

Striker 300 is received in the opening 313 of striker spacer sleeve 312 so that third body portion 307 and second body portion 305 extend through opening 313 past first end 312A. First body portion 303 is positioned inside of opening 313. A slot (not shown) in striker spacer sleeve 312 permits receiving portion 303A to be positioned below striker spacer sleeve 312 inside of second end 312B.

Striker spring 314 is positioned on second body portion 305 between first end 312A of striker spacer sleeve 312 and third body portion 307. Spring cup 318 is positioned on second body portion 305 so that striker spring 314 is partially positioned over portion 319 and rests against and is retained by shoulder 321.

In use, before the trigger of the pistol is pulled, striker 300 is in a first position wherein it does not cause power to flow from the power source 110 to the laser sub-assembly 260. When the trigger of the automatic pistol is pulled it causes the gun's firing pin to move, contact striker sear catch 310, and move sear catch 310 backward. This causes striker 300 to move backward from its first position creating tension by expanding striker spring 314. The sear striker catch 310 is configured to allow the firing pin to cam (or move) away from contact with striker sear catch 310 as striker 300 is pushed farther back. When the gun's firing pin no longer contacts striker sear catch 310, spring 314 urges striker 300 forward past its first position and to its second position in which striker 300 causes power to be directed from power source 110 to laser sub-assembly 260. This is preferably caused by conformable tip 316 striking a switch (not shown), such as a momentary switch, that contacts PCB 270. That causes PCB 270 to go from a first mode, wherein it does not transfer power from power source 110 to laser sub-assembly 260, to a second mode in which it does transfer power from power source 110 to laser sub-assembly 260. Spring 314 then returns striker 300 to its first position in which conformable tip 316 is not touching a switch or otherwise causing power to be directed to laser sub-assembly 260.

Striker 300 replaces the striker associated with the original striker of the automatic pistol and interacts with the firing pin of the pistol in the same manner, but when it moves out of contact with the firing pin and moves forward to its second position it causes power to be directed to laser module sub-assembly 260. In contrast, the pistol's original striker strikes the back of a bullet housing, which causes the bullet to fire.

The circuitry, such as circuitry on the PCB, is configured to power the laser sub-assembly 260 for any suitable period of time, such as about 0.1 seconds, or any range from about 0.05 to 0.3 seconds, or any other suitable time, so a user can preferably see laser light projected on a target.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed:

1. A slide configured to fit on an automatic pistol, the slide comprising: (a) a cavity, (b) a housing in the cavity, (c) a laser module positioned at least partially in the housing, the laser module having a first end that emits laser light and a second end, (d) a power source, (e) circuitry, (f) a striker, wherein the striker has a first position and a second position, in the first position the striker does not contact the power source and thereby does not provide power to the laser module, while in the second position the striker contacts the power source to provide power from the power source to the laser module; and a trigger reset assembly in the cavity, the trigger reset assembly having a trigger reset bar and a spring having a first end attached to the housing and a second end attached to the trigger reset bar, the trigger reset assembly configured to bias a trigger of the automatic pistol to a forward position after the trigger has been pulled, without the slide housing moving.

2. The slide of claim 1, wherein the trigger reset bar is connected to the housing.

3. The slide of claim 1, wherein the striker is configured to move to the second position when contacted and moved backwards from the first position by a firing pin of the automatic pistol and then released by the firing pin.

4. The slide of claim 3, wherein the striker includes a spring, wherein the spring is not compressed when the striker is in the first position, and the spring moves the striker to the second position when the striker is released by the firing pin.

5. The slide of claim 3, wherein the striker includes a striker sear catch and the firing pin contacts the strike sear catch.

6. The slide of claim 3, wherein the striker returns to the first position after moving to the second position.

7. The slide of claim 1, wherein the first end of the laser module is received in a module cushion ball, wherein the module cushion ball and the first end of the laser module are moveable up and down and sideways.

8. The slide of claim 7, wherein set screws are positioned against the module cushion ball, and are configured to be moved in order to cause the module cushion ball and the first end of the laser module to move up and down, and sideways.

9. The slide of claim 8, further comprising a top wall, a first side wall and a second side wall, an opening in the top wall and an opening in the second side wall, wherein the openings are configured to receive the set screws.

10. The slide of claim 1, wherein the circuitry is on a printed circuit board (PCB).

11. The slide of claim 1, wherein the housing includes a laser module top cover.

12. The slide of claim 1, wherein the power source is one or more batteries.

13. The slide of claim 12, wherein the power source is configured to be removed and replaced with another power source.

14. The slide of claim 1, further comprising a top wall and a cap in the top wall, wherein the cap is removable to expose the power source.

15. The slide of claim 1, further comprising a removable nose piece.

16. The slide of claim 15, further comprising a body to which the removable nose piece is attached.

17. The slide of claim 1, wherein the striker has a body that is aligned with a longitudinal axis of a barrel of the automatic pistol.

18. A kit including the slide of claim 1 and one or more interchangeable nose pieces configured to fit an automatic pistol.

* * * * *